US009709928B2

(12) United States Patent
Embry et al.

(10) Patent No.: US 9,709,928 B2
(45) **Date of Patent: *Jul. 18, 2017**

(54) DRIVE MECHANISM FOR AN INTERMEDIATE TRANSFER MEMBER MODULE OF AN ELECTROPHOTOGRAPHIC IMAGING DEVICE

(71) Applicant: LEXMARK INTERNATIONAL, INC., Lexington, KY (US)

(72) Inventors: Kerry Leland Embry, Midway, KY (US); Alexander J Geyling, Lexington, KY (US); Bartley Charles Gould, II, Lexington, KY (US); Robert Watson McAlpine, Lexington, KY (US); Harald Portig, Versailles, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/290,318

(22) Filed: Oct. 11, 2016

(65) Prior Publication Data

US 2017/0090357 A1 Mar. 30, 2017

Related U.S. Application Data

(63) Continuation of application No. 14/866,176, filed on Sep. 25, 2015, now Pat. No. 9,488,935.

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS 9,488,935 B1 * 11/2016 Embry ..... G03G 15/1615

* cited by examiner

*Primary Examiner* — David M Gray
*Assistant Examiner* — Laura Roth

(57) ABSTRACT

An intermediate transfer member (ITM) module including a frame; a backup roll and a drive roll rotatably disposed along a first end portion of the frame. A tension roll is rotatably disposed along a second end portion of the frame. An ITM belt forms an endless loop around the backup roll, the drive roll and the tension roll such that rotation of the drive roll causes the ITM belt to translate and the tension roll and the backup roll to rotate. The drive roll and the backup roll form a transfer nip with a transfer roll. A drive mechanism is coupled between the drive roll and the backup roll and includes a plurality of gears. The drive mechanism overdrives the backup roll relative to the drive roll while limiting an amount of tension of the ITM belt in the second transfer nip.

10 Claims, 8 Drawing Sheets

DRIVE MECHANISM FOR AN INTERMEDIATE TRANSFER MEMBER MODULE OF AN ELECTROPHOTOGRAPHIC IMAGING DEVICE

CROSS REFERENCES TO RELATED APPLICATIONS

This application claims priority and benefit as a continuation of U.S. application Ser. No. 14/866,176, filed Sep. 25, 2015.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to an imaging device and is particularly directed to an intermediate transfer member (ITM) module of the type which controls the tension of the ITM belt of the ITM module within a predetermined range of tension.

2. Description of the Related Art

Toner transfer is a core process in an electrophotographic printing process. The process starts when a photosensitive roll, such as a photoconductor drum, is charged and then selectively discharged to create a charge image. The charge image is developed by a developer roll covered with charged toner of uniform thickness. This developed image then travels to what is referred to as "first transfer" in the case of a two step transfer system, or the only transfer process in the case of direct-to-paper systems.

In either system, the toner enters a transfer nip area between a photoconductor drum and a transfer roll. The media to which the developed toner image is to be transferred, either a transfer belt for a two step transfer system or a transport belt supporting paper for a direct-to-paper system, is positioned between these two rolls.

In a two step transfer system, the transfer belt, now carrying the charged toner, travels to a second transfer nip, similar in some ways to the first transfer nip. The toner is again brought into contact with the toner receiving medium in the second transfer nip formed by a number of rolls. Typically a conductive backup roll and a resistive transfer roll together form the two primary sides of the second transfer nip. Other designs include the use of two backup rolls disposed along the inside of the transfer belt for forming a wide second transfer nip.

For example, some printer architectures dispose the drive roll, which causes the transfer belt to rotate, between the first transfer nips and the second transfer nip. This allows first transfer to be isolated from nip shock effects of heavy media sheets entering second transfer and allows transfer belt tensioning in the web region where changes in belt length do not affect leading edge margins. In one such design, one of the two backup rolls which forms the second transfer nip is the drive roll.

Such a printer architecture is not without its shortcomings. The use of the drive roll as a backup roll at second transfer may result the in transfer belt wrapping less around the drive roll, thereby adversely affecting drive capability over the life of the transfer belt. Further, the transfer belt may tend to pull away from the media sheet at second transfer, thereby forming an air gap which results in an onset of transfer that occurs later than desired as well as premature Paschen breakdown, thus negating the benefit of a wide second transfer nip.

SUMMARY

Example embodiments are directed to an intermediate transfer member (ITM) module for an electrophotographic imaging device, including a frame; a backup roll disposed along a first end portion of the frame, the backup roll being rotatable within the frame and including a backup roll gear; a drive roll disposed along the first end portion of the frame in proximity with the backup roll and including a drive gear; a tension roll disposed along a second end portion of the frame and being rotatable within the frame; and an ITM belt rotatably coupled to the frame. The ITM belt forms as an endless loop around the backup roll, the drive roll and the tension roll such that rotation of the drive roll causes the ITM belt to translate and the tension roll and the backup roll to rotate. The drive roll and the backup roll form at least part of a second transfer nip with a second transfer roll of the electrophotographic imaging device when the ITM module is operably disposed therein. The ITM module further includes a drive mechanism coupled to the drive gear and the backup roll gear and including a plurality of gears and a clutch. In an example embodiment, the drive mechanism tends to overdrive the backup roll relative to the drive roll while limiting an amount of torque applied to the backup roll so as to control an amount of tension of the ITM belt between the drive roll and the backup roll created by overdriving the backup roll. In this way, the example embodiments provide sufficient tension in the ITM belt at the second transfer nip to eliminate or reduce an air gap between the ITM belt and a sheet of media to achieve desired toner transfer characteristics while ensuring that overdriving the backup roll does not create excessive belt tension in the second transfer nip.

In an example embodiment, the plurality of gears include a first gear and a second gear and the clutch is coupled between the first gear and the second gear. The first gear is coupled to the drive gear, the second gear is coupled between the first gear and the backup roll gear, and the clutch is a friction clutch. The friction clutch includes a wrap spring with a first end coupled to the first gear and an uncoupled second end. The first gear includes a plate member having a first surface from which gear teeth of the first gear extend and a second surface from which at least one engagement structure extends. The first end of the wrap spring engages with the at least one engagement structure of the first gear such that when the first gear rotates in a first direction, the wrap spring and the second gear rotate with the first gear. The friction clutch limits the amount of torque provided to the second gear by wrap spring slipping relative to the second gear. In this way, excessive tension of the ITM belt in the second transfer nip is avoided despite the backup roll being overdriven relative to the drive roll.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
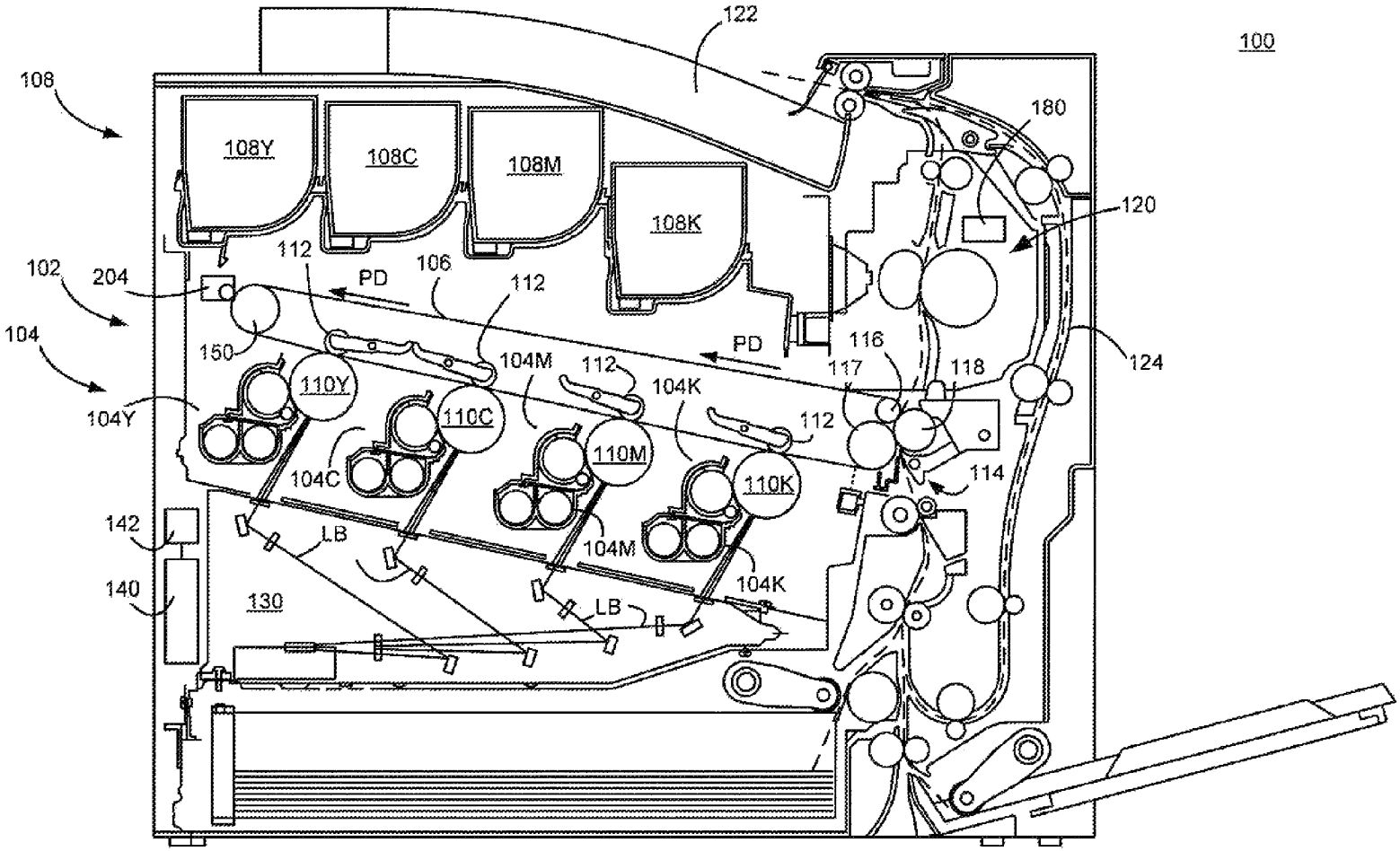
FIG. 1 is a side elevational view of an imaging device having therein an ITM module according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) belt 106. Each developer unit 104 holds a different color toner. The developer units 104 may be aligned in order relative to a process direction PD of ITM belt 106 indicated by the arrow in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110*y*, 110C, 110M and 110K that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

Figure 2:
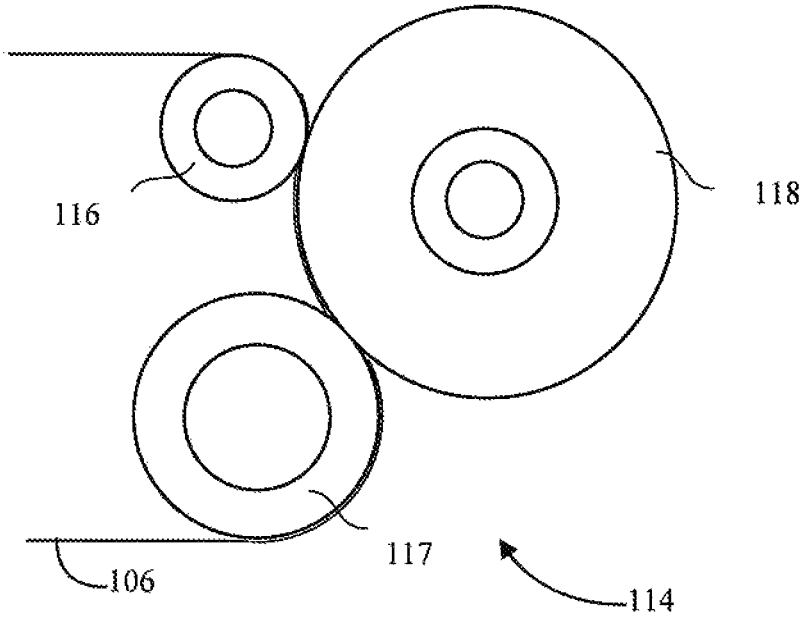
FIG. 2 is a simplified side view of the second transfer nip of the imaging device of FIG. 1.

ITM belt 106 rotates and collects the one or more toner images from the one or more developer units 104 and then conveys the one or more toner images to a media sheet at a second transfer area 114. Second transfer area 114 includes a second transfer nip formed between backup roll 116, drive roll 117 and a second transfer roll 118. FIG. 2 illustrates second transfer area 114 formed by backup roll 116, drive roll 117 and second transfer roll 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Figure 3A:
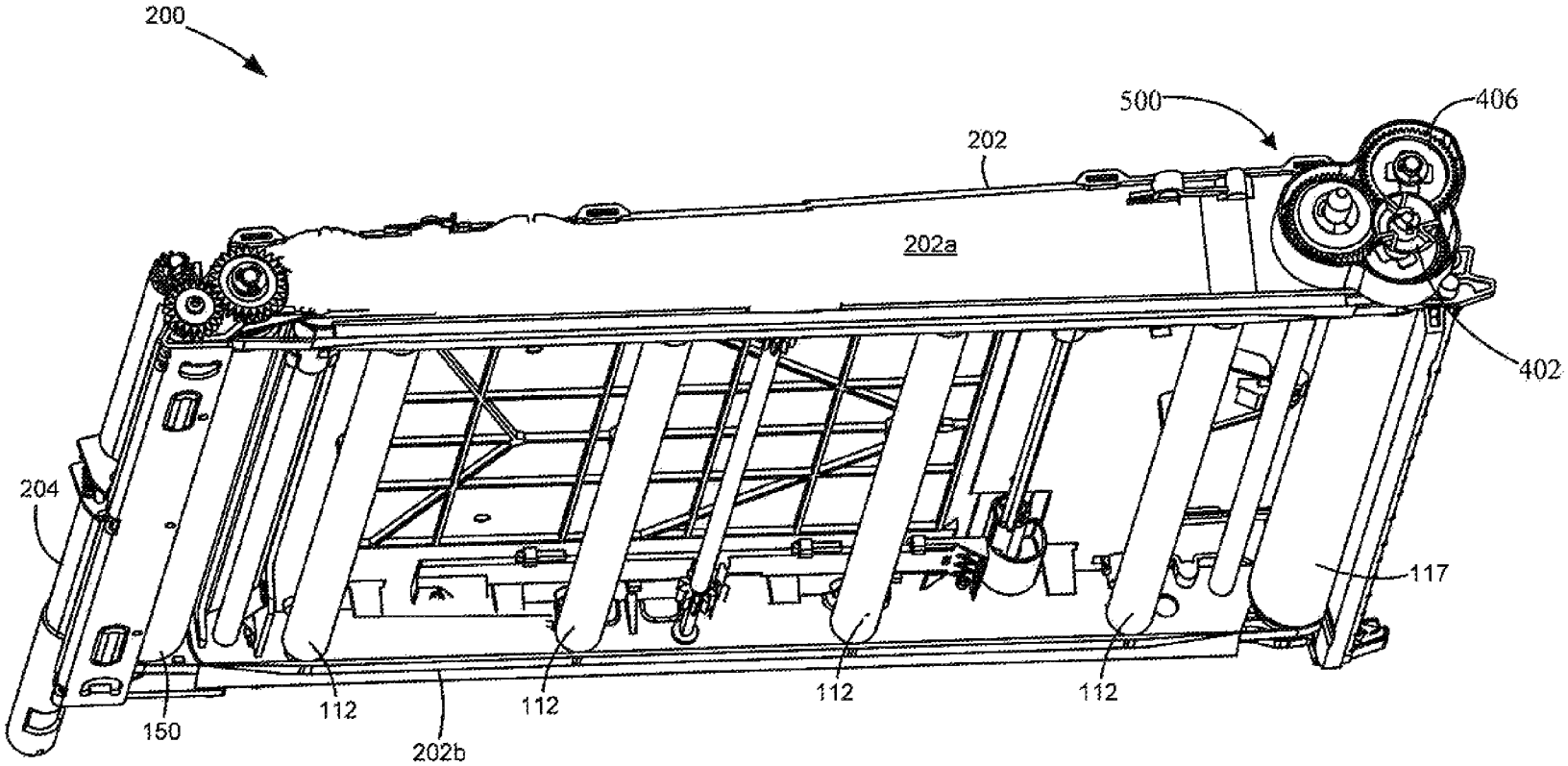
FIGS. 3A and 3B are perspective views of the ITM module according to an example embodiment.
Figure 3B:
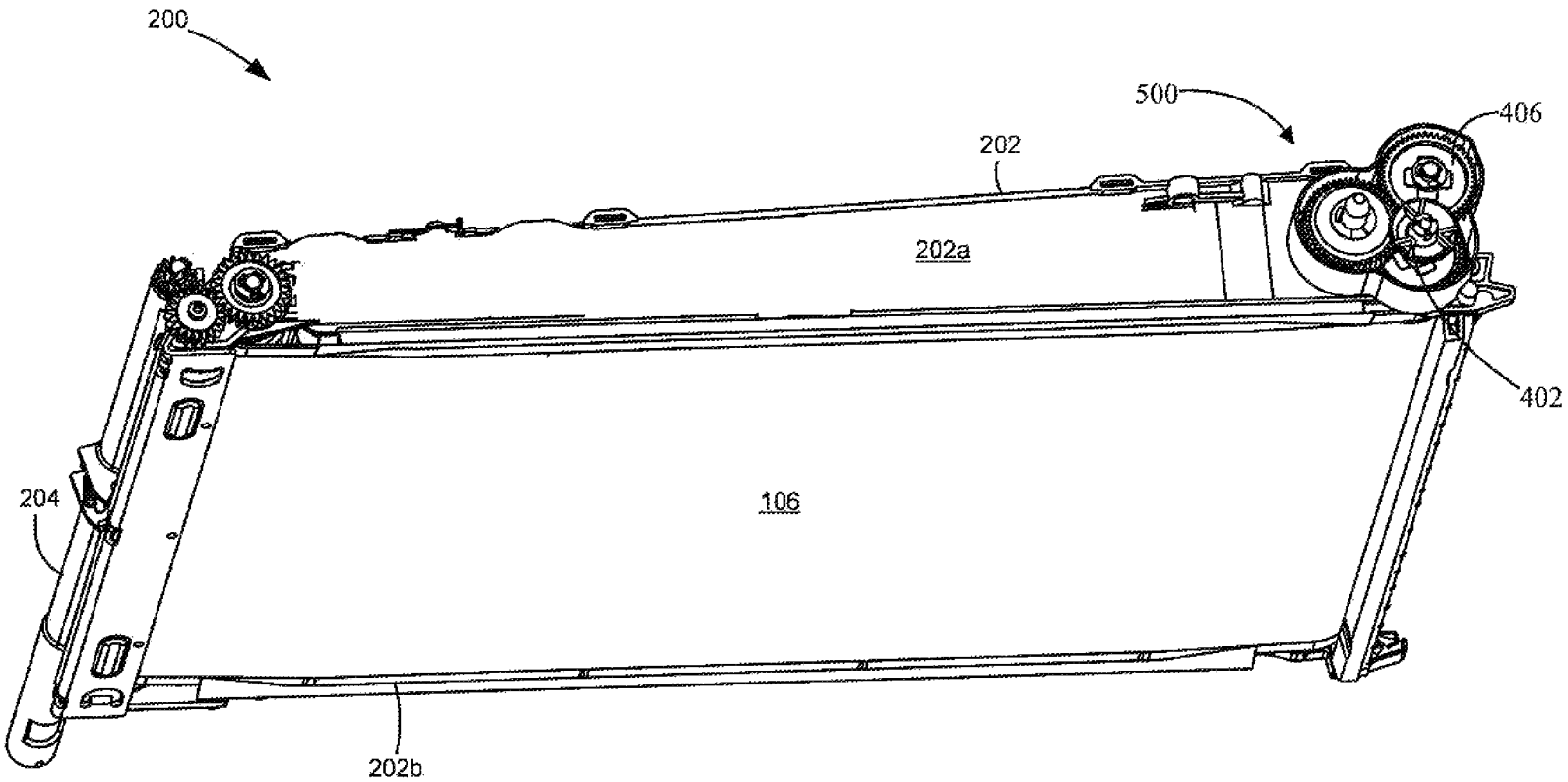

ITM belt 106 may be part of an ITM module in which ITM belt 106, transfer members 112, backup roll 116, drive roll 117 and tension roll 150 are disposed. Referring to FIGS. 3A and 3B, ITM module 200 includes a frame 202. Transfer members 112 are rotatably coupled at spaced apart locations along the length of frame 202 and biased substantially downwardly so as to be positioned against a corresponding photoconductive member 110Y, 110C, 110M and 110K through ITM belt 106. Backup roll 116 and drive roll 117 are disposed at a front end of frame 202 (i.e., the right side in FIGS. 3A and 3B), and tension roll 150 is disposed at a back end of frame 202. ITM belt 106 is disposed around backup roll 116, drive roll 117 and tension roll 150 so as to be engaged therewith. In an example embodiment, drive roll 117 is a driven roll such that rotation of drive roll 117 causes backup roll 116, second transfer roll 118 and tension roll 150 to rotate about their respective axes and ITM belt 106 to translate about backup roll 116, second transfer roll 118 and tension roll 150. ITM module 200 further includes a cleaning unit 204 (FIGS. 1, 3A and 3B) which is disposed at the back end portion of frame 202. Cleaning unit 204 includes a blade (not shown) which contacts ITM belt 106 to remove residual toner therefrom. Cleaning unit 204 is disposed upstream of yellow developer unit 104Y along ITM belt 106 so that residual toner is removed therefrom prior to a subsequent imaging operation. Cleaning unit 204 may also include an interior space for collecting the residual toner that is removed by the blade of cleaning unit 204 and an auger for moving the collected residual toner to a waste toner container (not shown) in imaging device 100. The blade of cleaning unit 204 contacts ITM belt 106 at a location adjacent to the location of tension roll 150. In this way, tension roll 150 provides a surface against which the blade of cleaning unit 204 may indirectly contact to ensure effective removal of residual toner from ITM belt 106.

FIG. 3A illustrates ITM module 200 without ITM belt 106. As can be seen, ITM module 200 includes a frame 202 having sides 202*a* and 202*b* between which transfer members 112 are rotatably mounted. Transfer members 112 extend downwardly from a bottom of frame 202 for forming first transfer areas 102 with photoconductive members 110Y, 110C, 110M and 110K. Drive roll 117 and tension roll 150 are also rotatably coupled between sides 202*a* and 202*b* of frame 202. FIG. 3B illustrates a fully assembled ITM module 200 including ITM belt 106.

Figure 4:
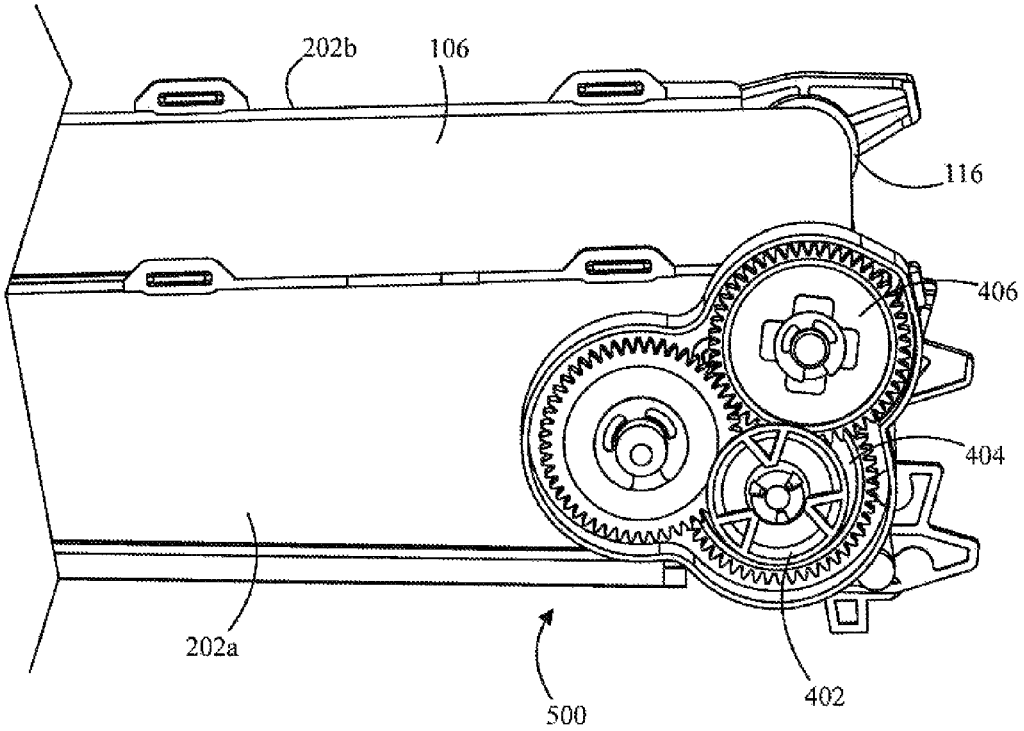
FIG. 4 is a perspective view of an end portion of the ITM module of FIG. 3B according to an example embodiment.
Figure 5:
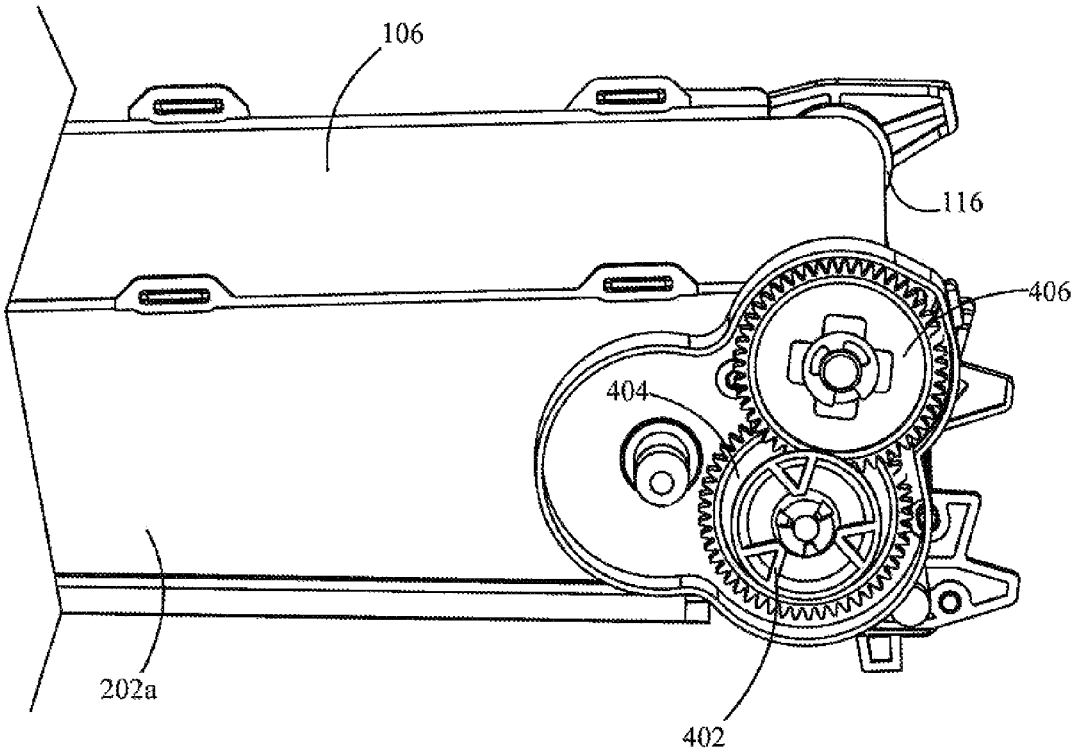
FIG. 5 is a perspective view of the end portion of the ITM module of FIG. 3B according to an example embodiment, without a drive mechanism.

FIG. 4 depicts the front end portion of ITM module 200. ITM module 200 includes drive coupler 402 which is connected to drive roll 117 so that drive roll 117 rotates with drive coupler 402. Drive coupler 402 engages with a drive unit (not shown) within imaging device 100 for providing power to drive roll 117. Also connected to drive roll 117 is drive gear 404 (best seen in FIG. 5, with components removed) which is disposed behind drive coupler 402 along the shaft about which drive roll 117 rotates. Drive gear 404 is used to apply torque to backup roll 116 as described in greater detail below. Drive coupler 402, drive gear 404 and drive roll 117 rotate in unison.

Figure 6:
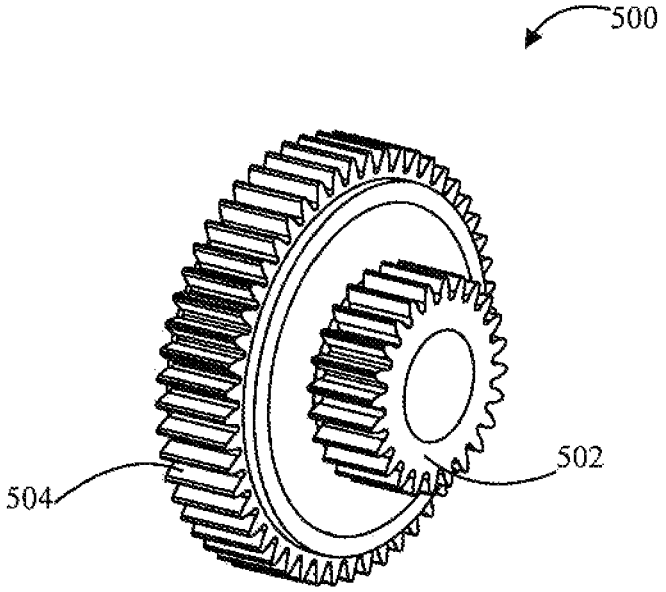
FIG. 6 is a perspective view of the drive mechanism of the ITM module of FIGS. 3A and 3B according to an example embodiment.

Referring to FIGS. 3A, 3B, 4 and 5, ITM module 200 further includes a backup roll gear 406 which is connected to backup roll 116 so as to rotate therewith. According to example embodiments, ITM module 200 further includes a drive mechanism 500 coupled between drive gear 404 and backup gear 406 for driving backup roll 116. In an example embodiment, the drive mechanism includes first gear 502 (best seen in FIGS. 6-8) having gear teeth which engage with drive gear 404. Drive mechanism 500 further includes second gear 504 having gear teeth which engage with backup roll gear 406.

According to example embodiments, drive gear 404, backup roll gear 406 and first gear 502 and second gear 504 of drive mechanism 500 are configured to slightly overdrive backup roll 116 relative to drive roll 117 in an absence of any compensation or other control. The amount of overdrive may be a small percentage, such as about five percent. By slightly overdriving backup roll 116 relative to drive roll 117, the tension of ITM belt 106 in second transfer area 114 is increased which serves to eliminate or at least reduce separation between ITM belt 106 and a media sheet in second transfer area 114 which is seen to adversely affect toner transfer characteristics of second transfer area 114.

By overdriving backup roll 116 without any compensation or other control, backup roll 116 rotates faster than drive roll 117. The difference in rotational speed would cause the tension in ITM belt 106 in second transfer area 114 to become very large, pulling ITM belt 106 very tight so as to force transfer roll 118 away from backup roll 116 and drive roll 117. The stress on ITM belt 106 would become so high that ITM belt 106 would slip on backup roll 116, drive roll 117 or both backup roll 116 and drive roll 117. To avoid this situation from occurring, drive mechanism 500 includes a clutch mechanism which prevents backup roll 116 from creating excessive tension on ITM belt 106 in second transfer area 114, between backup roll 116 and drive roll 117. In this way, the clutch mechanism of drive mechanism 500 provides a torque limiting function for controlling ITM belt tension within second transfer area 114. With the clutch mechanism, drive mechanism 500 tends to overdrive backup roll 116. The actual speed of backup roll 116 is controlled by ITM belt 106, and specifically by backup roll 116 not slipping relative to ITM belt 106.

Figure 7:
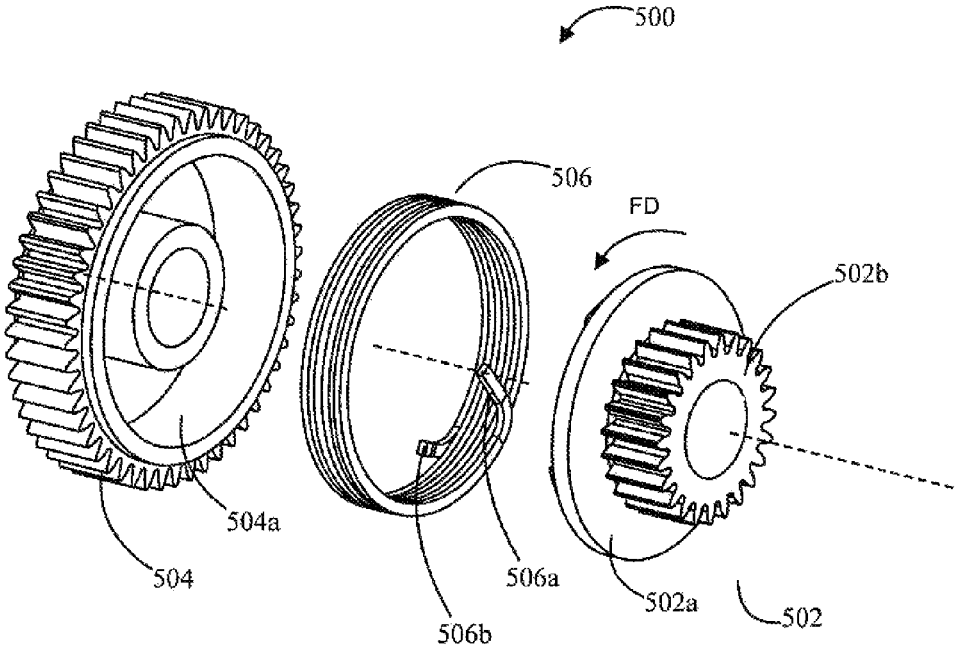
FIGS. 7 and 8 are exploded perspective views of the drive mechanism of FIG. 6.
Figure 8:
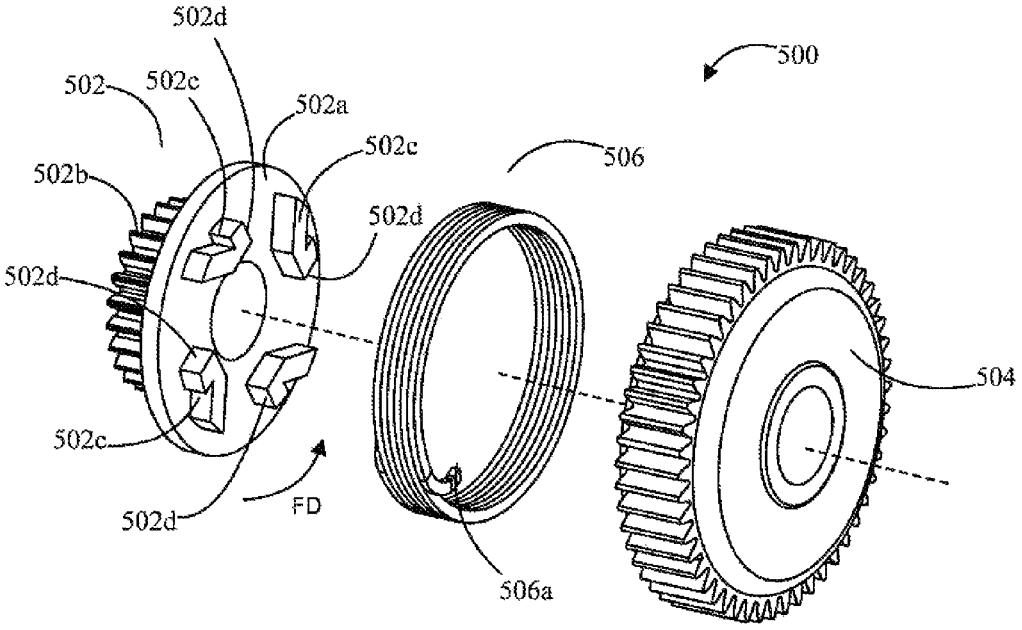

According to an example embodiment, the clutch mechanism is a friction clutch including a wrap spring 506. As shown in FIGS. 7 and 8, wrap spring 506 is formed as a relatively tightly wound coil having a first end 506*a* and a second end 506*b*. Wrap spring 506 is disposed within an inner space 504*a* of second gear 504. Wrap spring 506 forms a relatively tight engagement with the circumferential surface of inner space 504*a* of second gear 504. First end 506*a* of wrap spring 506 engages with first gear 502. Specifically, first gear 502 includes a plate member 502*a* having a surface from which gear teeth 502*b* of gear 502 extend. First gear 502 further includes engagement members 502*c* which extend from a second surface of plate member 502*a* opposite the surface of plate member 502*a* from which gear teeth 502*b* extend. Engagement members 502*c* are disposed substantially evenly about plate member 502*a* and are configured to engage with first end 506*a* of wrap spring 506. Each engagement member 502*c* includes a leading end 502*d* which is capable of engaging with first end 506*a* of wrap spring 506 when first gear 502 is rotated in a first direction FD corresponding to processing direction PD (FIG. 1) for performing an imaging operation. A single engagement member 502*c* engages with wrap spring 506 at a time, as described in greater detail below.

The amount of torque that drive mechanism 500 delivers to backup roll 116 is limited by the frictional engagement between wrap spring 506 and second gear 504. For torque values greater than a predetermined amount, the frictional engagement between wrap spring 506 and second gear 504 is overcome and wrap spring 506 slips within inner space 504*a* of second gear 504. Wrap spring 506 slipping within second gear 504 thereby serves to limit the torque delivered to second gear 504 to be no more than the predetermined amount, and the torque provided to second gear 504 is substantially constant. As a result, the torque limiting feature of drive mechanism 500 serves to compensate for backup roll 116 being overdriven relative to drive gear 117 so as to avoid any adverse effects from excessive tension of ITM belt 106 in second transfer area 114.

During an imaging operation, when first gear 502 is initially rotated in first direction FD, one engagement member 502*c* engages with first end 506*a* of wrap spring 506 and presents a rotational force onto first end 506*a* of wrap spring 506 which causes wrap spring 506 to rotate with first gear 502. At initial rotation, the load on second gear 504 from backup roll 116 and ITM belt 106 does not overcome the frictional engagement between wrap spring 506 and second gear 504 so that second gear 504 rotates with first gear 502 and wrap spring 506.

With continued rotation of first gear 502 in first direction FD, the tension of ITM belt 106 in second transfer area 114 increases due to backup roll 116 being slightly overdriven relative to drive roll 117. This presents an increasing force on second transfer roll 118 as ITM belt 106 as ITM belt 106 is pulled tight from the increased tension. Eventually a point is reached in which the load presented to second gear 504 requires an amount of torque which exceeds the predetermined torque amount to which the clutch of drive mechanism 500 is limited. At that point, wrap spring 506 slips within second gear while backup roll 116 continues to be driven by drive mechanism 500 via backup roll gear 406. Wrap spring 506 slipping relative to second gear 504 allows for the tension of ITM belt 106 in second transfer area 114 to lessen so that the tension is maintained within a desired range of tension amounts. In an example embodiment, the tension of ITM belt 106 within second transfer area 114 is between about 9 N and about 25 N.

The example embodiments described above show drive mechanism 500 as including a friction clutch disposed between first gear 502 and second gear 504. It is understood that the clutch of drive mechanism 500 may alternatively have other clutch architectures for limiting torque to backup roll 116.

The description of the details of the example embodiments have been described in the context of a color electrophotographic imaging devices. However, it will be appreciated that the teachings and concepts provided herein are applicable to multifunction products employing color electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. An electrophotographic imaging device, comprising:

a drive roll, including a drive gear coupled thereto, the drive gear having pluralities of first gear teeth;

a backup roll, including a backup roll gear coupled thereto, the backup gear having pluralities of second gear teeth;

an endless belt disposed about the drive roll and the backup roll at an end thereof, including a tension roll at an opposite end of the endless belt to keep in tension the endless belt about the drive roll and the backup roll at a toner transfer area, whereby rotation of the drive roll during use causes the endless belt to translate and rotate the backup roll and the tension roll; and first and second gears with pluralities of third gear teeth and fourth gear teeth, respectively, wherein the pluralities of third gear teeth of the first gear engage the first gear teeth of the drive roll and the pluralities of fourth gear teeth of the second gear engage the second gear teeth of the backup roll gear to overdrive the backup roll relative to the drive roll during use, but including a clutch between the first and second gears to limit an amount of tension in the endless belt at the toner transfer area.

2. The electrophotographic imaging device of claim 1, wherein the clutch comprises a wrap spring.

3. The electrophotographic imaging device of claim 2, wherein the second gear includes an inner space and the wrap spring is disposed within the inner space of the second gear.

4. The electrophotographic imaging device of claim 2, wherein the first gear includes a first surface which engages with the wrap spring and a second surface which supports the pluralities of fourth gear teeth.

5. The electrophotographic imaging device of claim 2, wherein the wrap spring and the second gear frictionally engage with one another and the wrap spring can slip relative to the second gear to alter an amount of torque the second gear applies to the backup roll during use.

6. The electrophotographic imaging device of claim 1, further including a transfer roll at the toner transfer area, a second roll contacting an outer surface of the endless belt, the backup roll and the drive roll contacting an inner surface of the endless belt thereby forming an image transfer nip at the toner transfer area.

7. The electrophotographic imaging device of claim 1, further including a frame having sides, whereby the backup roll and the drive roll rotatably mount to the sides.

8. The electrophotographic imaging device of claim 1, further including a frame having sides and a plurality of transfer member rolls are rotatably mounted to the sides between the end and the opposite end of the endless belt.

9. The electrophotographic imaging device of claim 8, wherein the plurality of transfer member rolls contact an inner surface of the endless belt.

10. The electrophotographic imaging device of claim 9, further including pluralities of photoconductive rolls contacting an outer surface of the endless belt opposite the plurality of transfer member rolls to form other toner transfer areas.

* * * * *